United States Patent [19]

Morioka et al.

[11] 4,122,658

[45] Oct. 31, 1978

[54] FALSE-TWIST YARN AND PROCESS

[75] Inventors: Atsumi Morioka; Tamotsu Nakashima, both of Otsu, Japan

[73] Assignee: Toray Industries, Inc., Tokyo, Japan

[21] Appl. No.: 828,502

[22] Filed: Aug. 29, 1977

[30] Foreign Application Priority Data

May 10, 1977 [JP] Japan ..... 52-53444

[51] Int. Cl.[2] ..... D02G 1/00; D02G 3/04

[52] U.S. Cl. ..... 57/140 R; 57/139; 57/140 C; 57/157 TS; 57/157 MS

[58] Field of Search ..... 57/140 R, 140 C, 153, 57/149, 156, 157 TS, 162, 164, 157 MS; 428/364, 373–375, 378, 395–397, 400, 401, 392; 264/140, 171; 156/166, 148, 296, 175, 179, 180

[56] References Cited

U.S. PATENT DOCUMENTS

| | | | |
|---|---|---|---|
| 3,350,488 | 10/1967 | Breen | 264/140 X |
| 3,531,368 | 9/1970 | Okamoto et al. | 57/140 BY X |
| 3,546,063 | 5/1968 | Breen | 428/364 |
| 3,645,819 | 2/1972 | Fujii et al. | 156/296 X |
| 3,716,614 | 2/1973 | Okamoto et al. | 156/296 X |
| 4,008,344 | 2/1977 | Okamoto et al. | 428/273 X |
| 4,055,941 | 11/1977 | Rivers et al. | 57/140 J X |

*Primary Examiner*—Donald Watkins
*Attorney, Agent, or Firm*—Miller & Prestia

[57] ABSTRACT

"Islands-in-a-sea" type composite filaments consisting of a relatively low melting point sea component and a plurality of higher melting point island components are false-twisted at a false-twisting temperature Q, wherein:

$$P + 10 \leqq Q < R$$

(wherein $P$ is the melting point of the sea component and $R$ is the melting point of each of the island components) to obtain a false-twist yarn. The cross-sectional configuration of the composite filaments as a whole undergoes deformation, but the cross-sectional configuration of each of the island components in said filaments undergoes substantially no deformation.

17 Claims, 10 Drawing Figures

FIG. 7.
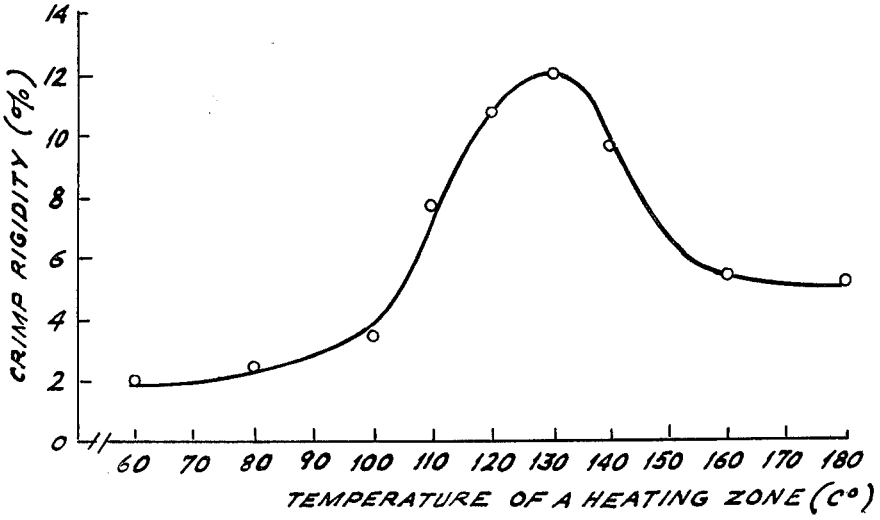
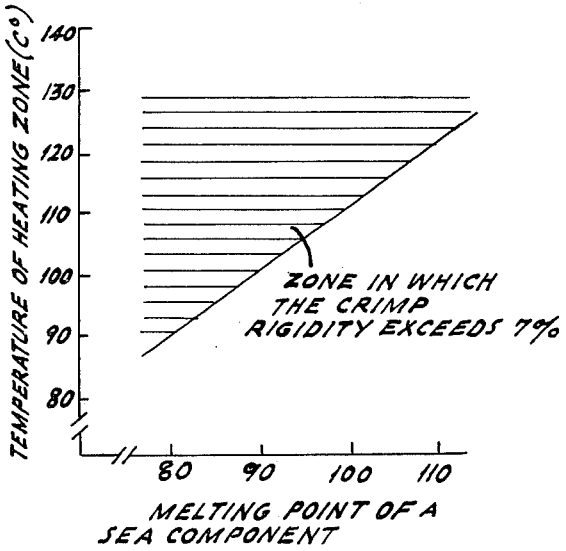
FIG. 8.
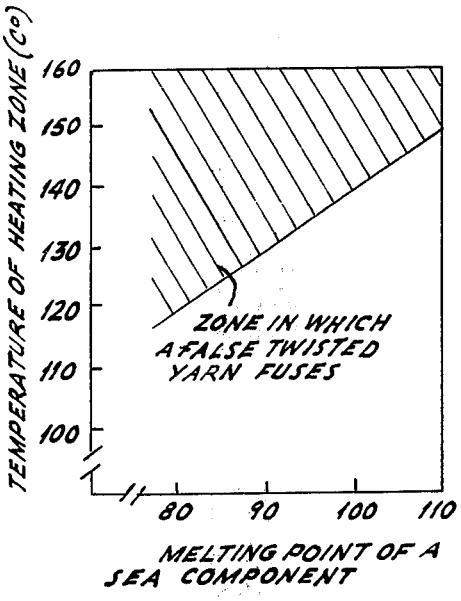
FIG. 9.

| TEMPERATURE OF HEATING ZONE | SIDE-ELEVATIONAL CONFIGURATION OF A FALSE-TWISTED YARN | CROSS-SECTIONAL CONFIGURATION OF FALSE-TWISTED YARN |
|---|---|---|
| 80°c |  |  |
| 110°c |  |  |
| 130°c |  |  |
| 140°c |  |  |
| 180°c |  |  |
| 200°c |  |  |

FALSE-TWIST YARN AND PROCESS

BACKGROUND OF THE INVENTION

The present invention relates to a false-twist yarn composed of "islands-in-a-sea" type composite filaments, and to a process for the production thereof. More particularly, the present invention relates to a false-twist yarn composed essentially of "islands-in-a-sea" type composite filaments, which filaments can later be made into superfine fibers. The invention also relates to a process for the production of such superfine fibers.

In conventional false-twist yarn, the cross-sectional configuration of each monofilament is crushed due to the forces applied in the false-twisting process, and the cross-sectional configuration established in the initial stage undergoes deformation, adversely affecting the luster and feel of the product.

In the case of an ordinary round cross-section yarn, deformation of the cross-sectional configuration due to false-twisting has not become a particularly serious problem. However, in the case of triangular or pentalobal filaments which develop luster and harshness of touch, any false-twist process which involves crushing has presented major problems.

On the other hand, since there is no other known means better than false-twisting for imparting bulkiness and stretch-ability to filaments with simplicity and economy, it has long been desired to provide for false-twisting without deforming the cross-sectional configurations of the filaments.

We are aware of Japanese Patent Application Publication No. 35613/1972. However, this publication is directed to mix weaving of a false-twist yarn with a non-false-twist yarn, with an optional possibility of developing crimp.

SUMMARY OF THE INVENTION

The present invention provides an excellent false-twist yarn product, and eliminates the aforementioned drawbacks of conventional false-twist yarn. The product is excellent in bulkiness and has easy handling characteristics similar to those of conventional false-twist yarn to respect to subsequent knitting or weaving operations. It functions without deforming the cross-sectional configurations of the individual monofilaments which remain in the final product.

The yarn according to this invention comprises a false-twist yarn of "islands-in-a-sea" type composite filaments consisting of a plurality of relatively high melting point island components and a relatively low melting point sea component, in which the cross-sectional configurations of the composite filaments as a whole undergo deformation, but the cross-sectional configurations of the island components in said filaments undergo substantially no deformation.

This invention also relates to a process for production of a false-twist yarn, which comprises false-twisting "islands-in-a-sea" type composite filaments consisting of a plurality of relatively high melting point island components and a relatively low melting point sea component by the use of a heating zone maintained at a temperature Q, which is defined as follows:

$$P + 10 \leqq Q < R$$

(wherein $P$ is the melting point of the sea component and $R$ is the melting point of each of the island components).

In the following description a detailed explanation will be provided with reference to the present invention. Specific terms will be used in the interest of clarity, but they are not intended to limit the scope of the invention, which is defined in the appended claims.

DRAWINGS

In the drawings:

FIG. 7 is a graph showing the relationship between the temperature of a false-twisting heating zone and the crimp rigidity of a false-twist yarn.

FIG. 8 is a graph showing a zone in which the crimp rigidity exceeds 7%.

FIG. 9 is a graph showing a zone in which a false-twist yarn fuses.

DETAILED DESCRIPTION OF THE INVENTION

Figure 1:
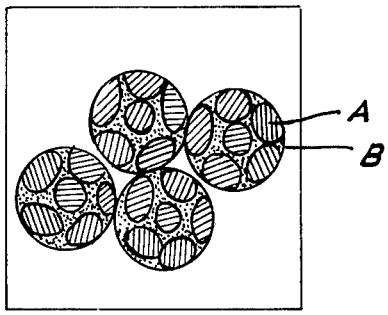
FIGS. 1–3 are cross-sections of "islands-in-a-sea" type composite filaments comprising embodiments of the present invention, prior to false-twisting.
Figure 2:
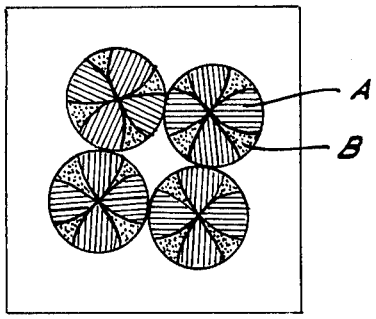
Figure 3:
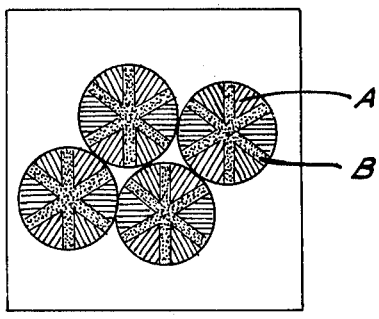

"Islands-in-a-sea" type composite filaments used for false-twisting according to the present invention are composite filaments in which one component is dispersed within another. However, the shape or configuration of such disposition is not particularly limited. Typical examples appear in FIGS. 1–3 of the drawings. In general, the wrapped portions are referred to as island components (A) and the wrapping portion is referred to as a sea component (B). However, the island components (A) need not be completely enclosed or encompassed by the sea component. Composite filaments in which the island components (A) are partly exposed are considered within the scope of the present invention.

Various polymers may be utilized for the island components (A). These may include thermoplastic polymers for clothing, such as polyethylene terephthalate or nylon.

However, for sea component (B), a thermoplastic polymer whose melting point is lower than that of the component (A) by at least about 100° C., preferably at least about 120° C., such as polystyrene or copolystyrene, is suitable.

When the difference between the respective melting points is less than about 100° C., the components (A) may possibly be deformed as a result of false-twisting, which is undesirable.

The percentage by weight of the island components to the total is preferably within the range of about 65–90%. When the weight percentage of the island components exceeds about 90%, and the sea component is subsequently removed, insufficient space is provided among the island components, resulting in increased friction among the monofilaments in the final product. The product is inferior in repulsion, and it becomes difficult to obtain a product having balance with respect to drapability and repulsion.

On the other hand, when the weight percentage of the island components is less than about 65% based upon the total, the space that is provided among the monofilaments after removal of the sea component becomes too large, the fabric resistance is lost and an organizational aberration called thread slippage tends to occur. A more preferable range of said weight ratio is 75–90%.

The denier of each of the island components may be within the range of about 0.001–10 denier (d). However, it is preferably about 0.5–0.9 d. When the denier exceeds 0.9 d, it is difficult to obtain a product having mild luster, soft surface touch and pliant drapability. On the other hand, when the denier is finer than 0.5 d, diffusion and reflection of the fiber become excessive, with the result that the color appears pale and it is not feasible to obtain the deep color tones often required for clothing.

The number of island components (monofilaments) is preferably about 3–10. When this number exceeds about 10, the rigidity of the composite filaments becomes too high; when the filaments are formed into a product the yarn does not bend enough and it becomes difficult to produce a product having high density. When the number of filaments in the yarn is less than 3, the filaments become too fine and the yarn tends to break at the time of subsequent warping, re-winding or drawing operations.

As stated, the composite filaments used in the present invention are deformable. Preferably, at least two island components thereof are different with respect to degree of cross-sectional deformation. Such composite filaments, when separated from the sea component and made into a product, being about changes in the bulkiness, feel and luster of the product and produce a product having a unique hand.

The degree of deformation referred to above is defined as the diameter of the circumscribed circle divided by the diameter of the inscribed circle.

It is especially preferable for such composite filaments to contain at least two island components that have degrees of deformation which differ by at least about 0.2.

False-twist yarn according to the present invention is produced as follows:

"Islands-in-a-sea" type composite filaments (30–250 d) are subjected to the action of a conventional false-twist spindle utilizing friction (friction-type spindle) where it is false-twisted to the extent of at least about 1000 t/m. This twist is fixed using a hot plate or hot tube on the twisting side, and the composite filaments are detwisted on the untwisting side. If necessary, the composite filaments may be subjected to a secondary heat set under low tension while being overfed after detwisting, and may be made into a processed yarn having no stretch, which is ordinarily called a bulky yarn. The number of twists and the processing tension are exactly the same as in an ordinary false-twist yarn.

In the present invention, it is indispensable to carry out the false-twisting step at a temperature within the following range:

$$P + 10 \leqq Q < R$$

(wherein $P$ is the melting point of the sea component and $R$ is the melting point of the island components).

The proper range is determined as a result of the following consideration.

Referring to FIG. 7, the change of crimp rigidity when "islands-in-a-sea" type composite filaments consisting of six 50 d/12 fil. polyester island components and a polystyrene sea component (melting point 100° C.) are twisted by 2700 t/m and the temperature of a heating zone is varied, is shown. The crimp rigidity referred to above is measured by the following method based on JIS (L1077, 1966):

a. The sample is wound up on a hank winder having a frame periphery of about 80 cm. It is wound under a tension of 0.1 g/d at a constant velocity to prepare a small hank having 10 windings.
b. The hank so obtained is immersed in hot water at 90° C. for 20 minutes in order to maintain the hank in an orderly configuration, and in order not to obstruct the contraction of the yarn. Thereafter the water is drained off by means of filter paper and the hank is allowed to stand in a horizontal arrangement for over 5 hours, so that the hank is not disturbed and the water is balanced.
c. At one end of the hank, an initial load of 2 mg/d and a load of 0.1 g/d are placed. The loads are quickly hung down into water at a temperature of 20° C. (plus or minus 2° C.) so that no shock is applied thereto, and the upper end of the hank is hooked and fixed.
d. After the hank has been allowed to stand in water for 2 minutes, the hank length (a) is measured and the load (0.1 g/d) is immediately removed.
e. Two minutes after the load (0.1 g/d) has been removed, the hank length (b) is again measured.
f. From the hank lengths (a) and (b), the crimp rigidity is calculated according to the following equation:

$$\text{Crimp rigidity} = (a - b)/a \times 100$$

The bulkiness expressed in crimp rigidity is preferably at least 7%.

Accordingly, as will be apparent from FIG. 7, the proper false-twist temperature is at least 110° C., namely, at least the sum of the melting point of the sea component plus 10° C. Further, by adding a plasticizer and varying the amount of the plasticizer (such as polyethylene glycol) added to the polystyrene, "islands-in-a-sea" type composite filaments (containing six 50 d/12 fil. polyester island components) whose melting point varies from 80° C. to 110° C. are produced, that are false-twisted (2700 t/m) and thereafter the temperature of a heating zone which would give a crimp rigidity of at least 7% is determined. The results are shown in FIG. 8.

As will be apparent from FIG. 8, in each case, by establishing the temperature of the heating zone at a value at least 10° C. higher than the melting point of the sea components it is possible to obtain a crimp rigidity of at least 7%. However, when the temperature of the heating zone is at least ($P$ + 40° C.), the yarn becomes a fused yarn in which the monofilaments adhere to one another. Because this fused yarn is mainly used for crepe woven fabric, the crimp rigidity need not be at least 7%.

Figure 10:
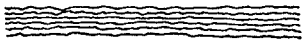
FIG. 10 is a diagram showing the relationship among the temperature of the heating zone and the cross-sectional and side-elevational configurations of resulting false-twist yarns.
Figure 10:
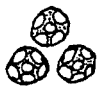
Figure 10:
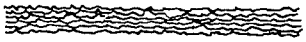
Figure 10:
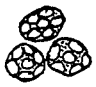
Figure 10:
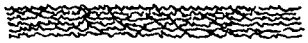
Figure 10:
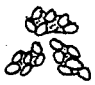
Figure 10:
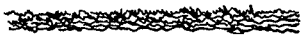
Figure 10:
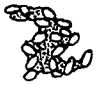
Figure 10:
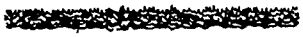
Figure 10:
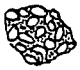
Figure 10:
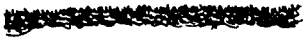
Figure 10:
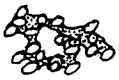

In FIG. 10, the side elevation and cross-section of yarns are shown. The yarns were obtained by false-twisting at 2700 t/m "islands-in-a-sea" type composite filaments consisting of six 50 d/12 fil. polyester island components and a polystyrene sea component (melting point 100° C.). The side elevation and cross-section, for each selected temperature, is shown.

Figure 5:
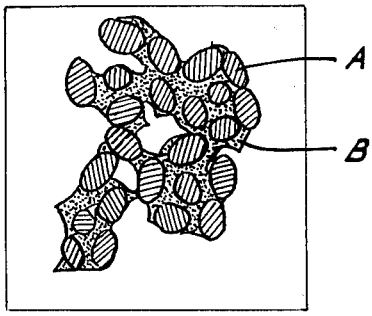
Figure 6:
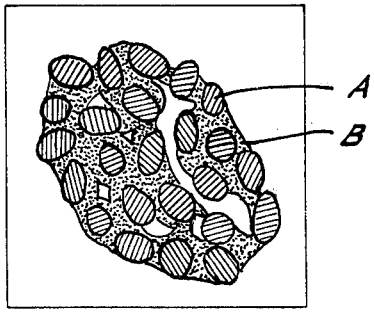

As appears in FIG. 10, when the temperature of the heating zone is at least 140° C., namely, higher than the melting point of the sea component by at least 40° C., fusion of the monofilaments takes place, as is shown in FIGS. 5 and 6.

As is shown in FIG. 8, the melting point of the sea component is varied from 80° C. to 110° C. by adding a plasticizer to the polystyrene sea component. "Islands-in-a-sea" composite filaments containing these sea components are false-twisted, and the temperature at which the monofilaments fuse are measured. The results are shown in FIG. 9. When Q becomes higher than the melting point of the island components, they are completely deformed. This is undesirable.

From the foregoing results, it will be clear that surprising results are obtained when the range of the temperature Q of the heating zone in the false-twist process is:

$$P + 10 \leqq Q < R$$

(when the melting point of the sea component is identified as $P$ and the melting point of the island components is identified as $R$). To avoid fusion of the monofilaments, the range of the temperature Q of the heating zone is:

$$P + 10 \leqq Q < P + 40.$$

Figure 4:
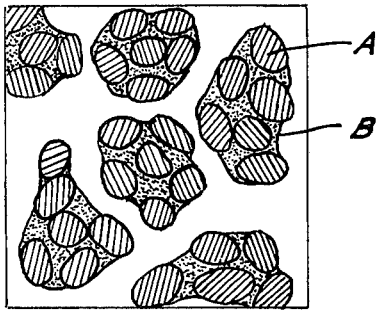
FIGS. 4–6 are cross-sections, respectively, of the filaments of FIG. 1 after false-twisting.

As mentioned, utilizing a false-twist process on "islands-in-a-sea" type composite filaments according to the present invention is advantageous. By doing so it is possible to produce a processed (false-twist) yarn without deforming the initially established cross-sectional configuration as shown in FIGS. 4–6. Nevertheless, the yarn has essentially the same performance as a normal false-twist yarn or a non-detwisted yarn for crepe woven fabric. Indeed, it is possible broadly to make the most of these yarns for knitted or woven fabrics for clothing, furniture or bedding.

Hereinbelow, the present invention will further be explained by reference to Examples.

EXAMPLE 1

"Islands-in-a-sea" type composite multifilaments consisting of 80% by weight of six 50 d/12 fil. polyester island components (melting point 265° C.) and 20% by weight of a polystyrene sea component (melting point 100° C.) were twisted 3300 t/m, false-twisted over a heater while the temperature of the heater was varied from 60° C. to 200° C. and the false twist characteristics of the resulting yarns were observed. The twisting tension was 7 g and the detwisting tension was 21 g.

Further, using each of these yarns as weft, and using an ordinary polyester stretch yarn (50 d/36 fil.) as warp on a loom, taffeta fabrics were woven.

The polystyrene sea component was dissolved out in trichloroethylene from these fabrics, and they were subjected to conventional finishing.

As a result, in the yarns obtained at false-twisting temperatures of $P + 10 \leqq Q < P + 40$ as disclosed in this specification, the initially established cross-sectional configurations of the original multifilaments were not deformed and the yarns had the same performances as did generally false-twisted yarns; the fabrics had excellent bulkiness and feel and, moreover, had mild luster and unique hand.

Fabrics obtained at false-twisting temperatures of $R > Q \leqq P + 40$ had excellent crimp development, and soft fabrics were obtained. They were not restricted by any substantial degree of fusion.

The observed results appear in Table 1.

TABLE 1

| False Twist temp. (° C) | Crimp Rigidity: Before removing the sea component | Crimp Rigidity: After removing the sea component | Occurrence of fusion | Crimped condition | Deformation of the cross-sectional configuration of the island component | Crimp Appearance |
|---|---|---|---|---|---|---|
| 60 | 1.9 | 0.8 | No fusion | Weakly crimped yarn | No | Poor |
| 80 | 2.4 | 1.1 | " | " | " | " |
| 100 | 3.5 | 1.8 | " | " | " | " |
| 110 | 8.6 | 7.7 | " | Ordinary false twist yarn | " | Fair |
| 120 | 11.4 | 9.6 | " | " | " | " |
| 130 | 12.1 | 10.8 | " | " | " | " |
| 140 | 9.8 | 7.2 | Partly fused | Non-detwisted yarn | " | Good |
| 150 | 7.9 | 5.6 | Wholly fused | " | " | " |
| 160 | 5.4 | 4.1 | " | " | " | Very good |
| 180 | 5.3 | 4.9 | " | " | " | " |
| 200 | 5.2 | 4.9 | Partly fused | " | " | Good |

EXAMPLE 2

"Islands-in-a-sea" type composite filaments consisting of 85% by weight of six 75 d/18 fil. nylon island components (melting point 235° C.) and 15% by weight of a polystyrene sea component (melting point 90° C.) were twisted to 2800 t/m, false-twisted while the temperature of the heater was varied from 60° C. to 170° C., and the false-twist characteristics of the resulting yarns were observed. At this time, the twisting tension was 10 g and the detwisting tension was 30 g.

Further, using each of these yarns as weft, and using a conventional nylon stretch yarn (50 d/17 fil.) as warp, taffeta fabrics were woven.

Polystyrene was removed from these fabrics by solution in perchloroethylene and the fabrics were subjected to conventional finishing.

As a result, in the yarns obtained at false-twist temperatures of $P + 10 \leqq Q < P + 40$ as disclosed herein, the initially established cross-sectional configurations of the original filaments were not deformed and the yarns had the same performances as ordinary false-twist yarns. The fabrics had unique hand, and had excellent luster, bulkiness and drapability.

The fabrics whose wefts were the yarns obtained at false-twist temperatures of $R > Q \geqq P + 40$ had excellent crimp development and good soft pebbled fabrics, not restricted by substantial fusion, were obtained.

The results of these observations are tabulated in Table 2.

TABLE 2

| False Twist Temp. (° C) | Crimp Rigidity: Before removing the sea component | Crimp Rigidity: After removing the sea component | Occurrence of fusion | Crimped State | Deformation of the cross sectional configuration of the island component | Crimp Appearance |
|---|---|---|---|---|---|---|
| 60 | 2.1 | 0.9 | No | Weakly crimped yarn | No | Poor |
| 80 | 3.9 | 2.1 | " | " | " | " |
| 100 | 9.7 | 7.4 | " | Ordinary false-twist yarn | " | Fair |
| 110 | 10.6 | 8.0 | " | " | " | " |
| 120 | 11.5 | 9.6 | " | " | " | " |
| 130 | 8.8 | 7.1 | Partly fused | Non-detwisted yarn | " | Good |
| 140 | 6.7 | 5.5 | Wholly fused | " | " | " |
| 150 | 6.3 | 5.1 | " | " | " | Very good |
| 160 | 5.2 | 4.3 | " | " | " | " |
| 170 | 4.8 | 4.1 | " | " | " | " |

We claim:

1. A false-twist yarn comprising a plurality of false-twisted "islands-in-a-sea" type composite synthetic polymer filaments, said filaments comprising a plurality of island components having a predetermined melting point, and a sea component having a melting point below that of said island components, characterized in that the cross-sectional configuration of the composite filament as a whole has been deformed the cross-sectional configuration of each of the island components in said filaments is substantially free of deformation.

2. A false-twist yarn according to claim 1, wherein said composite filaments are free of fusion to one another and the crimp rigidity of the yarn is at least 7%.

3. A false-twist yarn according to claim 1, wherein said composite filaments are fused to one another.

4. A false-twist yarn according to claim 1, wherein the difference between the melting point of each of said island components and that of said sea component is at least about 100° C.

5. A false-twist yarn according to claim 4, wherein the said difference is at least about 120° C.

6. A false-twist yarn according to claim 1, wherein said island components are selected from the group consisting of polyester and polyamide, and said sea component is polystyrene.

7. A false-twist yarn according to claim 1, wherein the weight ratio of said island components, based upon the total, is within the range of about 65–90%.

8. A false-twist yarn according to claim 1, wherein the number of said island components is from about 3 to 10.

9. A false-twist yarn according to claim 1, wherein the denier of each of said island components averages from about 0.5–0.9 d.

10. A false-twist yarn according to claim 1, wherein at least two island components are different in deformation degree of the cross-sectional configuration.

11. A process for the production of a false-twist yarn which comprises false-twisting "islands-in-a-sea" type composite filaments which comprise a plurality of higher melting point island components and a lower melting point sea component at the temperature Q, wherein Q satisfies the relationship $$P + 10 \leqq Q < R$$

wherein $P$ is the melting point of the sea component and $R$ is the melting point of the island components.

12. A process according to claim 11, wherein the difference between the melting point of said island components and that of said sea component is at least about 100° C.

13. A process according to claim 12, wherein the difference between the melting point of each of said island components from that of said sea component is at least about 120° C.

14. A process according to claim 11, wherein said island components are polyester or polyamide and said sea component is polystyrene.

15. A process according to claim 11, wherein said Q is within the following range:

$$P + 10 \leqq Q < P + 40$$

16. A process according to claim 11, wherein said Q is within the following range:

$$P + 40 \leqq Q < R$$

17. A false-twist yarn comprising a plurality of false-twisted "islands-in-a-sea" type composite filaments, said filaments comprising a plurality of thermoplastic island components having a predetermined melting point, and a thermoplastic polymer sea component having a melting point at least 100° C. lower than said island components, the percentage by weight of island components to the total weight of yarn being essentially within the range of 65–90%, the denier of each of said island components being within the range of about 0.001–10 denier, the cross-sectional configuration of the composite filament as a whole having been deformed, and the cross-sectional configuration of each of the island components in said filaments being substantially free of deformation.

* * * * *